US007647720B1

(12) United States Patent
Vendetti

(10) Patent No.: US 7,647,720 B1
(45) Date of Patent: Jan. 19, 2010

(54) BORE-SIGHT ALIGNMENT DEVICE

(75) Inventor: Vincent J. Vendetti, King George, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 12/316,558

(22) Filed: Dec. 8, 2008

(51) Int. Cl.
*F41G 1/16* (2006.01)

(52) U.S. Cl. ..... 42/126

(58) Field of Classification Search ..... 42/126, 42/125, 135–138
See application file for complete search history.

(56) References Cited

U.S. PATENT DOCUMENTS

| | | | | |
|---|---|---|---|---|
| 3,880,529 | A * | 4/1975 | Althause et al. | 356/251 |
| 4,079,534 | A | 3/1978 | Snyder | 42/1 |
| 4,161,076 | A | 7/1979 | Snyder | 42/1 |
| 4,742,636 | A * | 5/1988 | Swan | 42/126 |
| 5,092,071 | A | 3/1992 | Moore | 42/85 |
| 5,274,941 | A * | 1/1994 | Moore | 42/126 |
| 6,781,773 | B2 | 8/2004 | Willis | 359/831 |
| 7,140,143 | B1 * | 11/2006 | Ivey | 42/125 |
| 7,212,706 | B2 | 5/2007 | White et al | 385/33 |
| 2003/0051386 | A1 * | 3/2003 | Holler | 42/125 |
| 2006/0093269 | A1 | 5/2006 | Willis | 385/52 |
| 2007/0199227 | A1 * | 8/2007 | Ertl | 42/137 |

* cited by examiner

*Primary Examiner*—Michael Carone
*Assistant Examiner*—Reginald Tillman, Jr.
(74) *Attorney, Agent, or Firm*—Gerhard W. Thielman, Esq.

(57) ABSTRACT

An alignment mount is provided for adjusting elevation and azimuth between first and second axes for two respective devices attached thereto. The axes are substantially parallel to an axial direction and substantially perpendicular to lateral and vertical directions. These directions form a pitch plane by said axial and vertical directions, a yaw plane by said axial and lateral directions and a roll plane by said lateral and vertical directions. The mount is detachably disposable to first and second devices corresponding to the first and second axes. The mount includes first and second platforms respectively attachable to the first and second devices, an elevation block, an elevation screw, an elevation cam, an azimuth screw and an azimuth cam. The first platform includes a first slot that extends substantially in the yaw plane. The second platform includes a first bore and a first channel extending in tandem substantially in the axial direction. The elevation screw is rotatable within the first bore in the roll plane. The elevation block is insertable into the first channel and includes a second bore, a second channel and a second slot. The second bore and the second channel extend substantially in the axial direction. The azimuth screw is rotatable within the second bore in the roll plane. The second slot extends substantially in the pitch plane. The elevation cam translates within said first channel to engage with the second slot to rotate one end of the elevation block in the pitch plane in response to turning of the elevation screw. The elevation block and first platform can be pinned together at an opposite end to the first end. The first platform can include a Picatinny rail.

7 Claims, 8 Drawing Sheets

BORE-SIGHT ALIGNMENT DEVICE

STATEMENT OF GOVERNMENT INTEREST

The invention described was made in the performance of official duties by one or more employees of the Department of the Navy, and thus, the invention herein may be manufactured, used or licensed by or for the Government of the United States of America for governmental purposes without the payment of any royalties thereon or therefor.

BACKGROUND

The invention relates generally to adjusting bore-sight alignment of a weapon. In particular, the invention relates to fine-tuned elevation and azimuth adjustment of coupled hand-held assembly of rifle and gun-sight.

Targeting hardware, such as an optical gun-sight or other line-of-sight aiming device, that attaches to a rail-mount (e.g., Picatinny rail) often must be aligned to the barrel bore-sight of the rifle connected to the rail. Conventionally, this has been accomplished by adjusting the reticule of the viewing optics, or adjusting hardware within the attached system.

In some applications, shims are installed between components followed by tightening a bolt between components. This conventional process can be very time consuming due to the iterative nature of interdependent adjustment. Also, tightening the bolt after inserting shims can change the adjusted direction to which the assembly points after alignment, necessitating further correction.

SUMMARY

Conventional bore-sight alignment equipment yields disadvantages addressed by various exemplary embodiments of the present invention. In particular, various exemplary embodiments provide independent elevation and azimuth adjustments by an integrated mount.

Various exemplary embodiments provide an alignment mount for adjusting elevation and azimuth between first and second axes for two respective devices attached thereto. The axes are substantially parallel to an axial direction and substantially perpendicular to lateral and vertical directions. These directions form a pitch plane by said axial and vertical directions, a yaw plane by said axial and lateral directions and a roll plane by said lateral and vertical directions. The mount is detachably disposable to first and second devices corresponding to the first and second axes.

The mount includes first and second platforms respectively attachable to the first and second devices, an elevation block, an elevation screw, an elevation cam, an azimuth screw and an azimuth cam. The first platform includes a first (vertical) slot that extends substantially in the yaw plane. The second platform includes a first bore and a first channel extending in tandem substantially in the axial direction. The elevation screw is rotatable within the first bore in the roll plane.

The elevation block is insertable into the first channel and includes a second bore, a second channel and a second (horizontal) slot. The second bore and the second channel extend substantially in the axial direction. The azimuth screw is rotatable within the second bore in the roll plane. The second slot extends substantially in the pitch plane. The elevation cam translates within said first channel to engage with the second slot to rotate one end of the elevation block in the pitch plane in response to turning of the elevation screw.

In various exemplary embodiments, the elevation block and first platform can be pinned together at an opposite end to the first end. In preferred embodiments, the first platform can include a Picatinny rail.

BRIEF DESCRIPTION OF THE DRAWINGS

These and various other features and aspects of various exemplary embodiments will be readily understood with reference to the following detailed description taken in conjunction with the accompanying drawings, in which like or similar numbers are used throughout, and in which.

DETAILED DESCRIPTION

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

Figure 1:
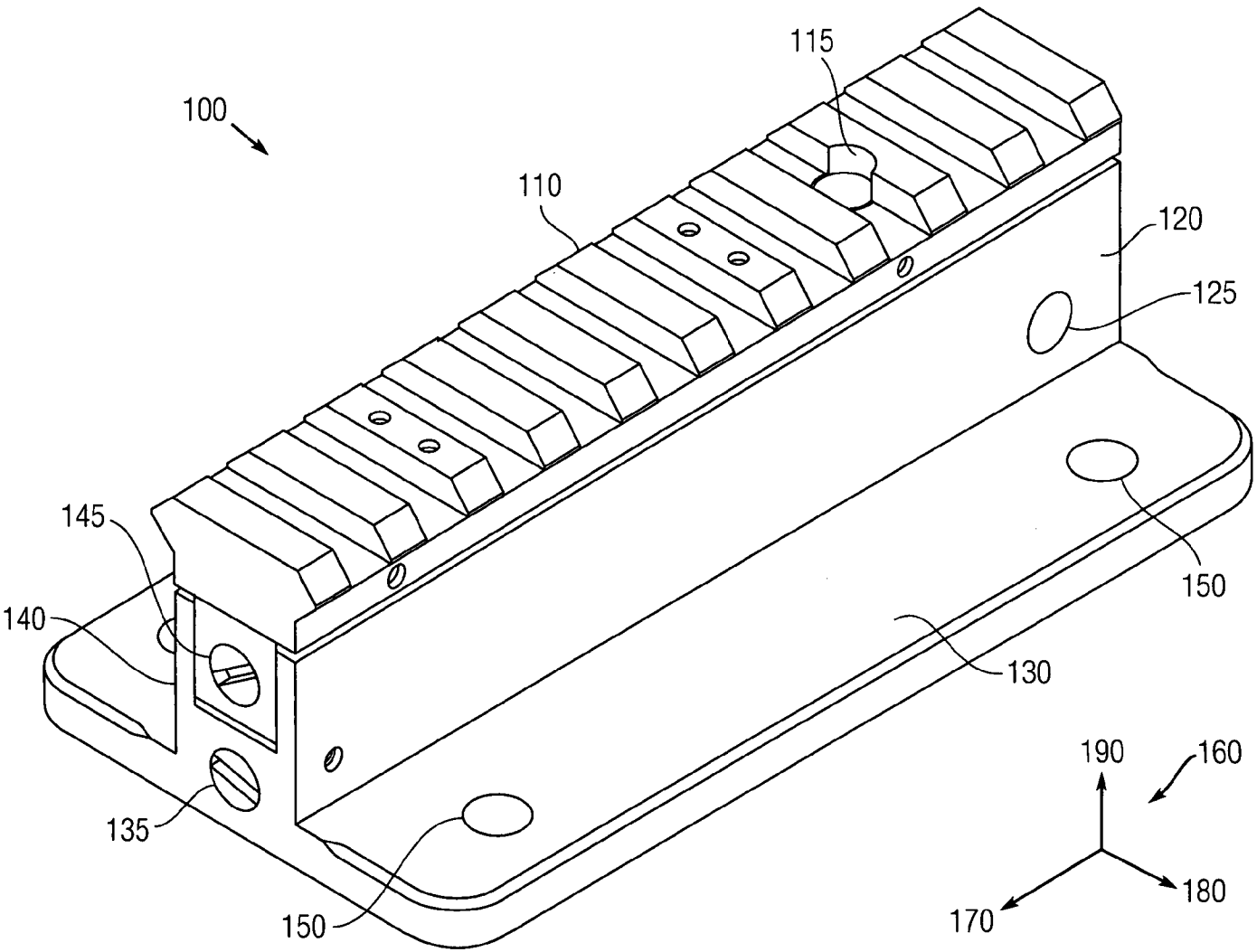
FIG. 1 is a solid perspective view of a bore-sight assembly.

FIG. 1 shows an isometric view 100 of a bore-sight assembly with a MIL-STD-1913 bracket (i.e., Picatinny rail) 110 as an equipment mount. The Picatinny rail 110, designed to detachably be secured to a platform (e.g., a remote weapons mount, vehicle, bench, etc.) or a hand-held rifle, includes a vertical bore 115 therethrough. The assembly includes a housing 120 with a lateral bore 125 extending therethrough. The housing 120 integrally connects to a base 130 to form a mounting block. A first longitudinal (elevation) bore 135 extends within the integrated housing 120.

An elevation block 140 is disposed longitudinally between the Picatinny rail 110 and the housing 120. A second longitudinal (azimuth) bore 145 extends within the block 140. To mount the assembly to another platform (e.g., an optical gun-sight, not shown), the base 130 includes vertically oriented orifices 150 for bolts to pass therethrough.

For purposes of orientation, the view 100 displays a local geometry compass rose 160 to depict orthogonal Cartesian axes in the axial (aft, facing the operator) 170, lateral (starboard) 180 and vertical (upward) 190 directions. These three directions form perpendicular surface planes corresponding to alignment adjustment: the axial and lateral axes form a yaw plane; the axial and vertical axes form a pitch plane; and the lateral and vertical axes form a roll plane. The pitch plane corresponds to elevation changes. The yaw and roll planes correspond to azimuth changes.

Figure 2:
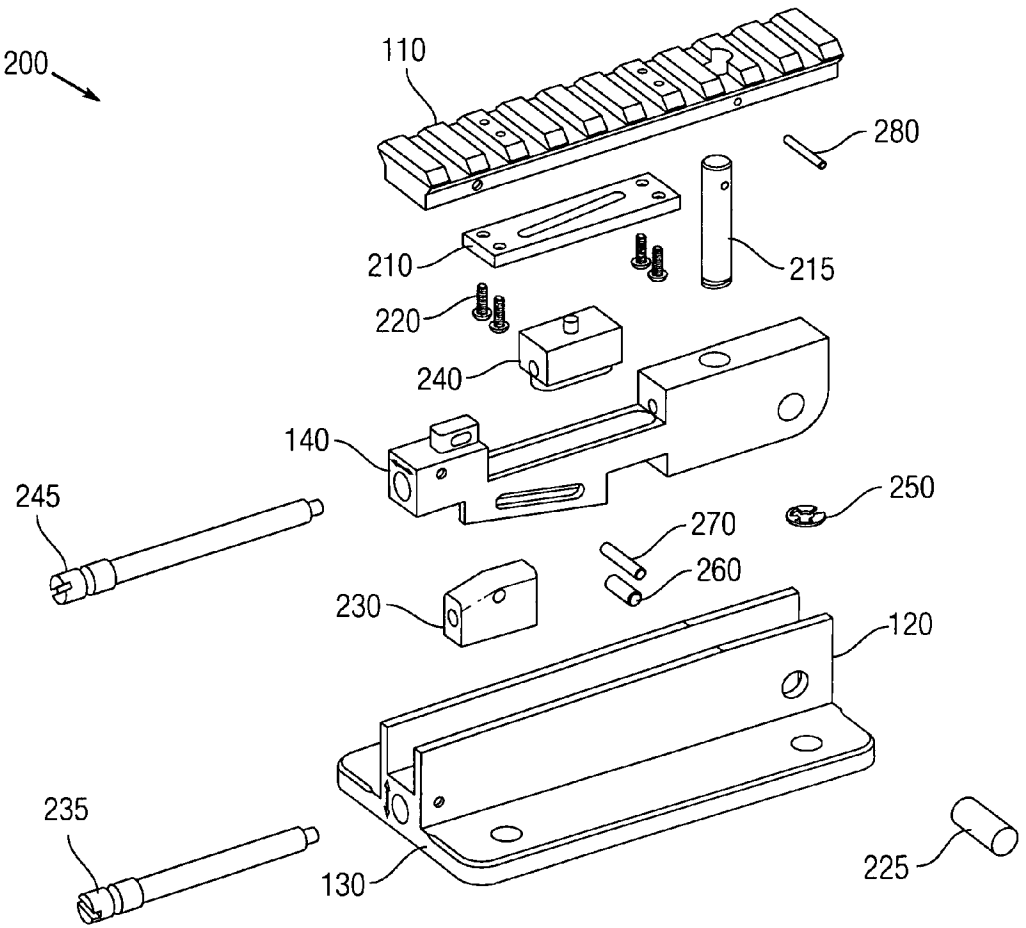
FIG. 2 is an exploded view of the bore-sight components.

FIG. 2 shows an isometric exploded view 200 of bore-sight components. A cam block 210 and a pivot shaft 215 are shown below the Picatinny rail 110. The cam block 210 attaches to the Picatinny rail 110 by a set of four screws 220 mounted vertically from below. The pivot shaft 215 inserts into the vertical bore 115 of the rail 110. A pivot pin 225, disposed adjacent to the housing 120, inserts into the lateral bore 125.

An elevation lead cam 230 is shown between the elevation block 140 and the housing 120. An elevation lead screw 235, disposed forward of the elevation block 140, inserts into the first longitudinal bore 135. An azimuth lead cam 240 is shown between the cam block 210 and the elevation block 140. An azimuth lead screw 245, disposed forward of the elevation block 140, inserts into the second longitudinal bore 145.

A retaining ring 250 secures the pivot shaft 215 in the elevation block 140. The pivot shaft 215 secures the forward ends of the rail 110 and the elevation block 140 disposed between the cam 230 and the elevation block 140. Elevation and azimuth pins 260, 270, disposed between the cam 230 and the ring 250, insert into corresponding slots of the elevation block 140. A lock pin 280 secures the pivot shaft 215 and the Picatinny rail 110. The retaining pin 270 vertically secures the end of the rail 110 to the elevation block 140, while allowing horizontal motion.

Figure 3:
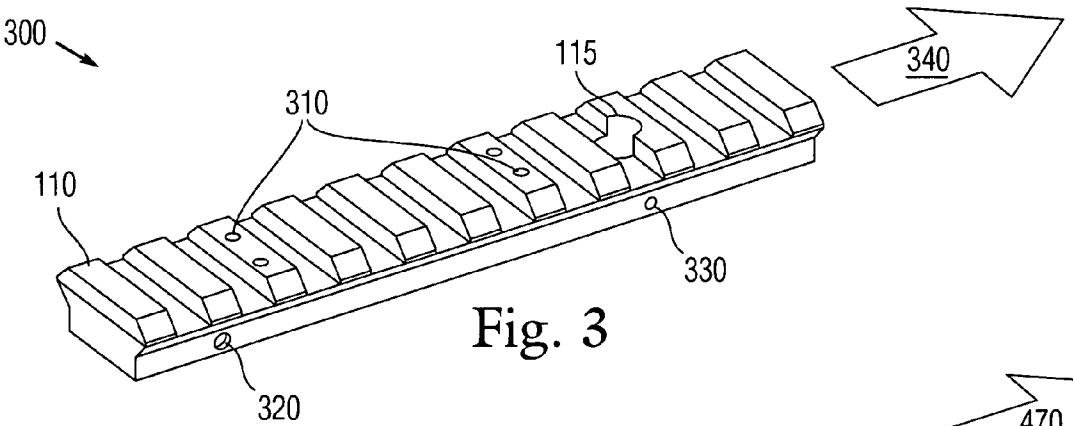
FIG. 3 is an exploded view of a rail.

FIG. 3 shows an isometric view 300 of the Picatinny rail 110. The screws 220 insert into threaded vertical cavities 310. A fore lateral orifice 320 passing through the rail 110 receives the retaining pin 270. An aft lateral orifice 330, also passing therethrough, receives the lock pin 280. The rail 110 aligns to a first longitudinal axis 340, such as corresponding to a barrel bore-sight of a rifle to which the rail 110 attaches. The first longitudinal axis 340 is substantially parallel with the axial direction 170 and substantially perpendicular the roll plane.

Figure 4:
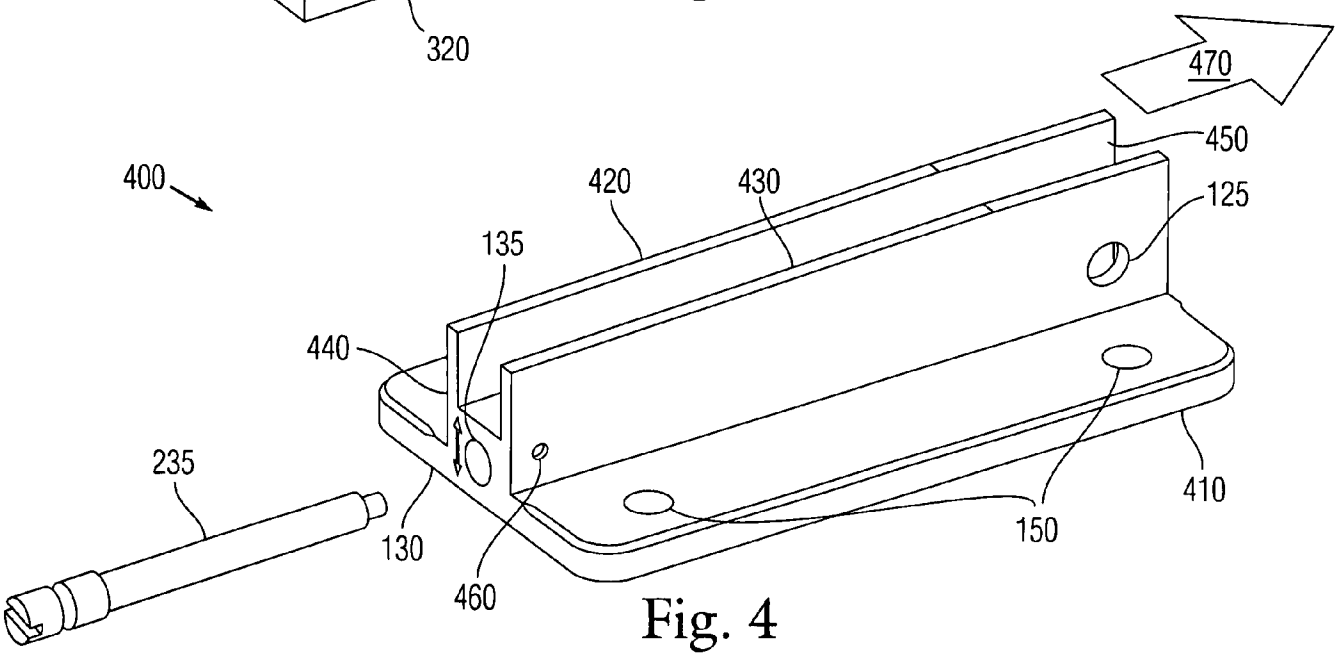
FIG. 4 is an exploded view of a mounting block.

FIG. 4 shows an isometric view 400 of the mounting block 410 composed of the housing 120 and the base 130, together with associated components. The mounting block 410 includes a port wall 420 and a starboard wall 430 that together flank a center divide 440 (to form the housing 120). The walls 420, 430 define an open insertion cavity (or elevation channel) 450. The center divide 440 extends from the block's aft end (that corresponds to an opening of the first longitudinal bore 135 for receipt of the elevation lead screw 235) to approximately mid-way forward. The mounting block 410 disposes the open cavity 450 and the first longitudinal bore 135 in tandem.

A lateral divide orifice 460 locks the elevation lead screw 235 from backing out from the first longitudinal bore 135. The mounting block 410 aligns to a second longitudinal axis 470, such as corresponding to an optical sight attached thereto. The second longitudinal axis 470 is substantially parallel with the axial direction 170 and substantially perpendicular to the roll plane.

Figure 5:
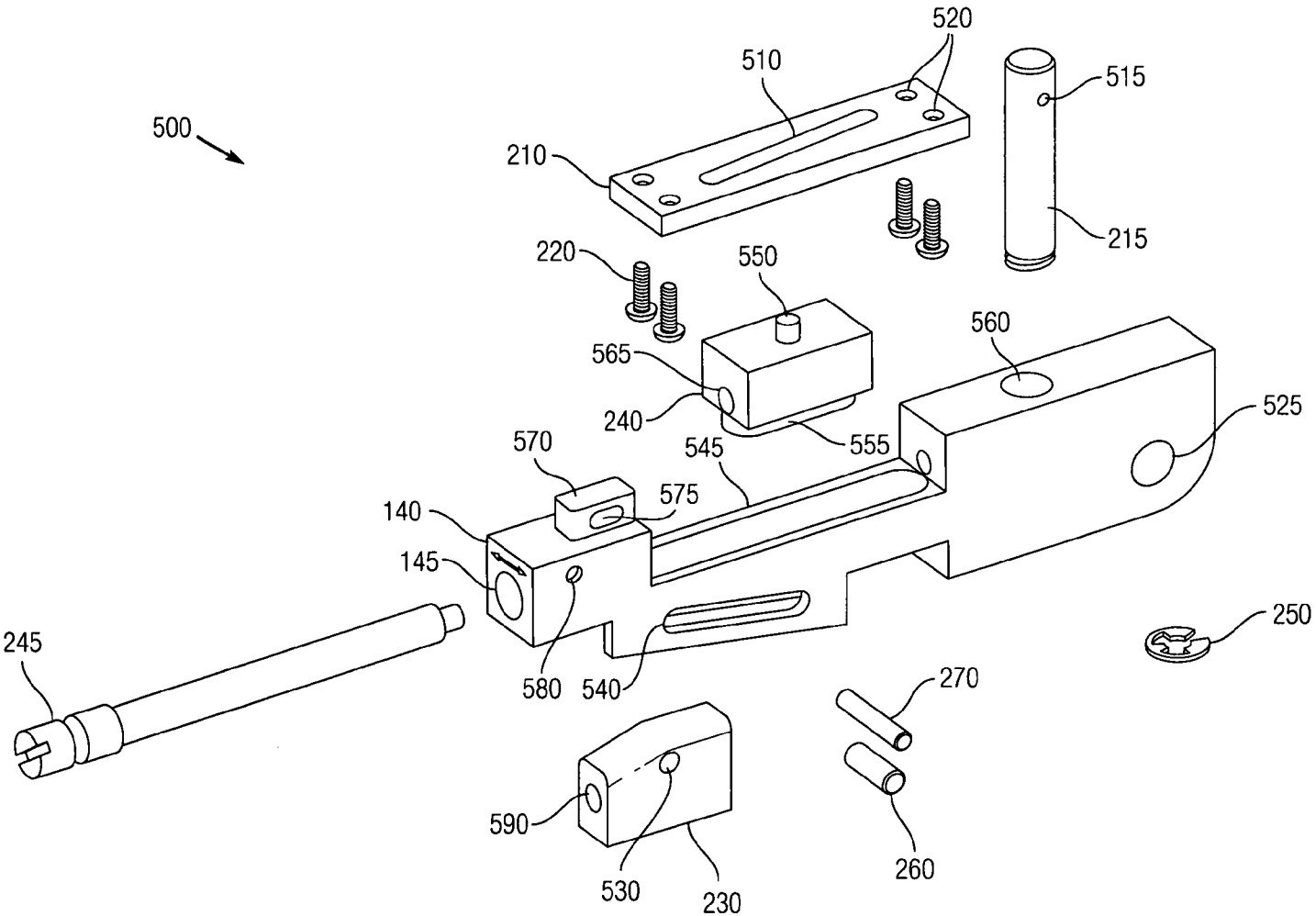
FIG. 5 is an exploded view of alignment adjustment components.

FIG. 5 shows an isometric exploded view 500 of alignment adjustment components. The cam block 210 includes a vertical slot 510 substantially in the yaw plane. In the depicted configuration, the vertical slot 510 extends substantially in the axial direction 170, but also shifting partially in the lateral direction 180 from aft starboard to forward port. The pivot shaft 215 includes a laterally extending orifice 515 to receive the lock pin 280 to secure to the rail 110. The cam block 210 also includes vertical holes 520 through which the screws 220 pass to insert into the cavities 310 of the rail 110.

The elevation block 140 includes an aft lateral orifice 525 co-linear with the lateral bore 125 to receive the pivot pin 225. The elevation lead cam 230 includes a lateral orifice 530 aligning with lateral slots 540 substantially in the pitch plane. In the depicted configuration, the lateral slots 540 extend substantially in the axial direction 170, but also shifting partially in the vertical direction 190 from forward up to aft down. The slots 540 and the orifice 530 receive the elevation pin 260. The fore end of the elevation block 140 (opposite to the opening for receipt of the azimuth lead screw 245) extends downward into the open cavity 450 forward of the center divide 440 of the mounting block 410.

The elevation block 140 includes an azimuth channel 545. The slots 540 are disposed along walls of the channel 545 that inserts into the open cavity 450 (above the center divide 440). An azimuth button 550 and a longitudinal tang 555 extend vertically (respectively upward and downward) from the azimuth lead cam 240. The slot 510 receives the azimuth button 550. The channel 545 receives the tang 555 to slide thereal-ong. A vertical orifice 560 passes through elevation block 140 aft of the channel 545 to receive the pivot shaft 215. The ring 250 secures the pivot shaft 215 from vertical displacement below the elevation block 140. A threaded longitudinal azimuth cam orifice 565 extends within the azimuth lead cam 240 to receive the azimuth lead screw 245.

An azimuth knob 570, extends above the elevation block 140 forward of the channel 545. The knob 570 includes a short lateral slot 575 to receive the retaining pin 270. A lateral orifice 580 extends through the elevation block 140 forward and below the knob 570. A threaded longitudinal elevation cam orifice 590 extends into the elevation lead cam 230.

Figure 6:
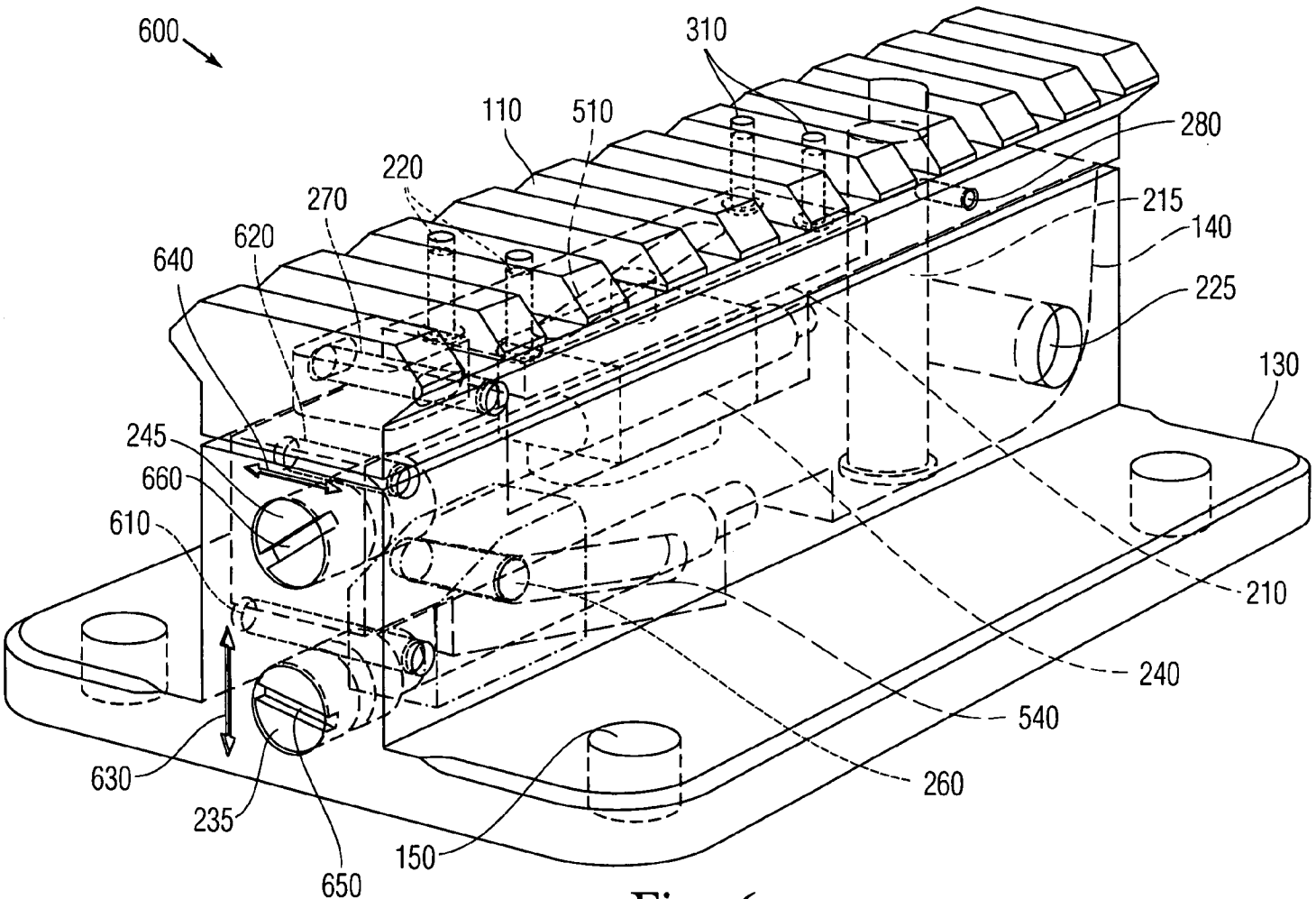
FIG. 6 is a transparent perspective view of the bore-sight assembly.

FIG. 6 shows an isometric transparent view 600 of a bore-sight assembly. The screws 220 are disposed through the vertical holes 520 of the cam block 210 and into the cavities 310 of the rail 110. An elevation lock pin 610 is disposed in the center divide 440 through the lateral orifice 460 to inhibit longitudinal movement of the elevation lead screw 235 in the axial direction 170. An azimuth lock pin 620 is disposed in the walls 420, 430 and the elevation block 140 through their respective lateral orifices 320 and 580 to inhibit longitudinal movement to inhibit longitudinal movement of the azimuth lead screw 245.

The elevation lead screw 235 provides vertical alignment adjustment as indicated by etched arrow 630. The azimuth lead screw 245 provides lateral alignment adjustment as indicated by etched arrow 640. Both lead screws 235, 245 insert into their respective bores 135, 145 to be disposed substantially in the axial direction 170. The elevation lead screw 235 can turn by a screw-driver through an elevation notch 650. The azimuth lead screw 245 can turn by a screwdriver through an azimuth notch 660.

Figure 7:
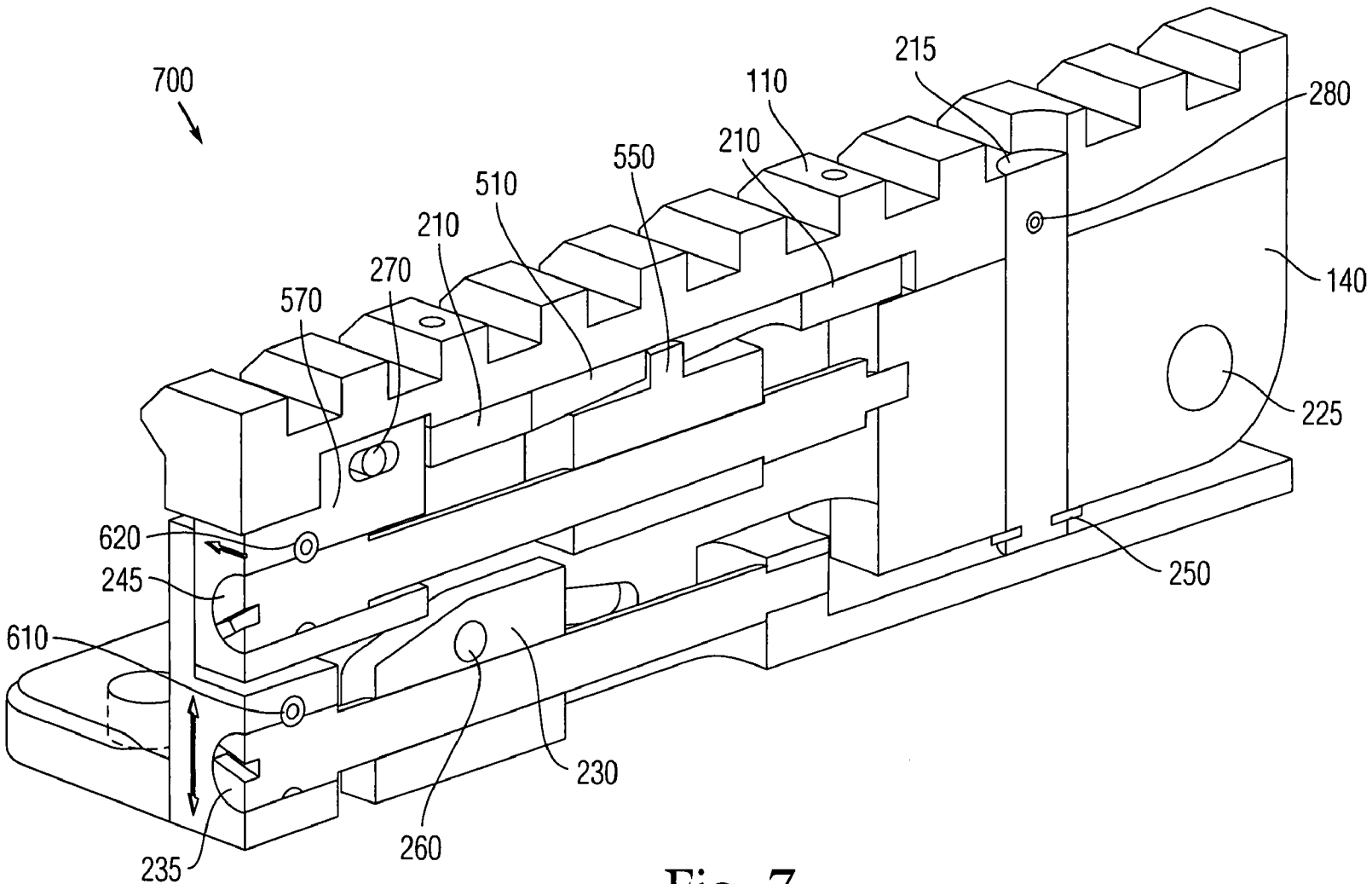
FIG. 7 is a solid cutaway perspective view of the bore-sight assembly.

FIG. 7 shows an isometric solid cutaway view 700 of the port side of the bore-sight assembly. The pivot shaft 215 is disposed within the Picatinny rail 110 and the elevation block 140 through their respective vertical orifices 115 and 560. The pivot shaft 215 is secured from undue rotation by the lock pin 280 that passes through the rail 110 and the pivot shaft 215 by their respective lateral orifices 330 and 515. The pivot pin 225 is disposed within the walls 420, 430 of the housing 120 and the elevation block 140 through their respective lateral orifices 125 and 525.

The elevation lead screw 235 is disposed in the center divide 440 of the housing 120 and the elevation lead cam 230 through their respective longitudinal orifices 135 and 590. The azimuth lead screw 245 is disposed in the elevation block 140 and the azimuth lead cam 240 through their respective longitudinal orifices 145 and 565. The elevation pin 260 passes through the lateral orifice 530 of the elevation lead cam 230 to engage the lateral slot 540. The button 550 is disposed within the vertical slot 510. The retaining pin 270 is disposed within the knob 570 through the slot 575.

Figure 8:
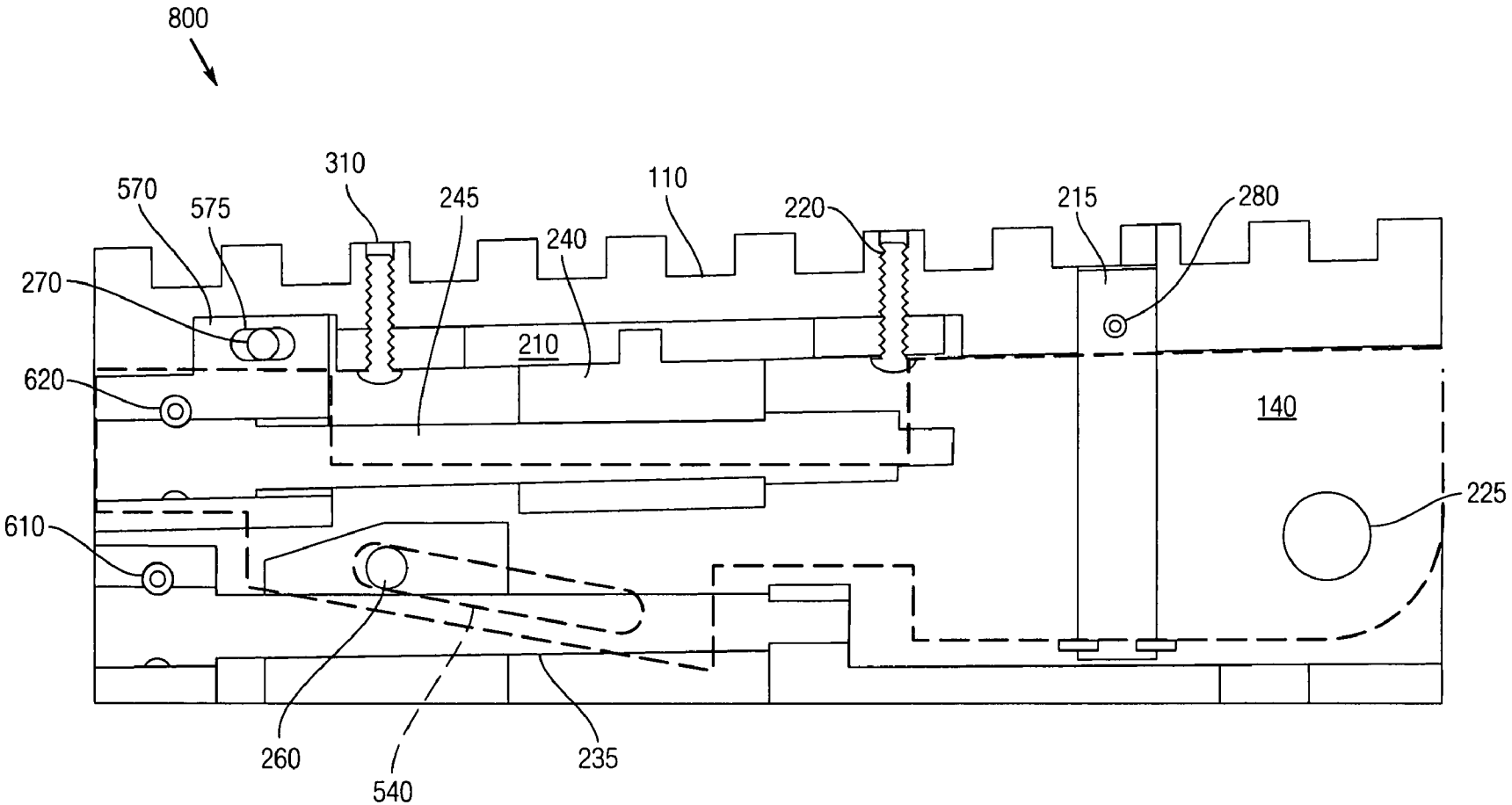
FIG. 8 is a solid cutaway elevation cutaway view of the bore-sight assembly.

FIG. 8 shows an elevation transparent view 800 of a bore-sight assembly as seen from the port side. As the elevation lead screw 235 turns, the elevation pin 260 slides longitudinally along the slot 540 to vertically depress or raise the forward end of the elevation block 140.

Figure 9:
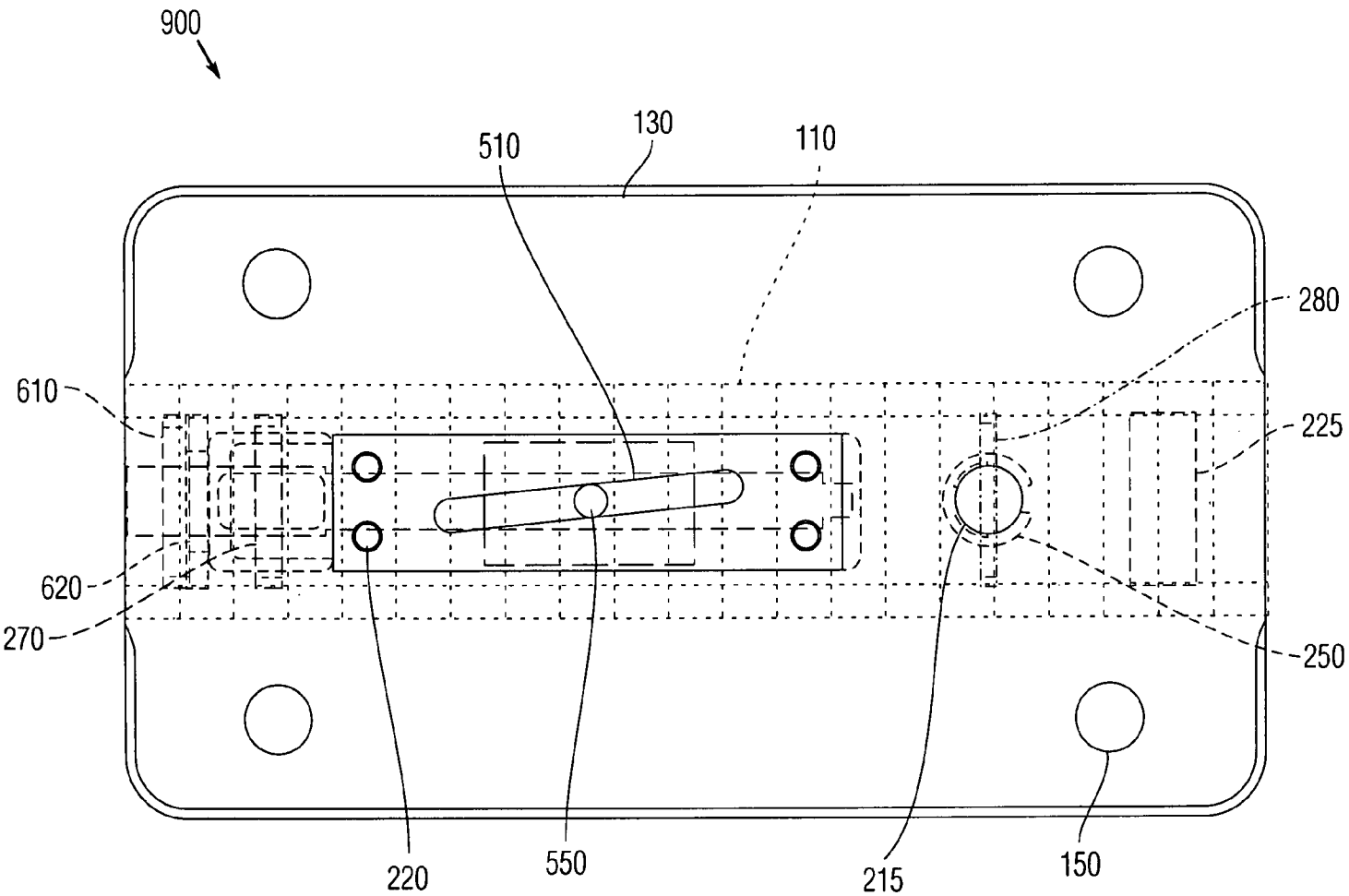
FIG. 9 is a solid cutaway plan cutaway view of the bore-sight assembly.

FIG. 9 shows a plan transparent view 900 of a bore-sight assembly as seen from the top. As the azimuth lead screw 245 turns, the button 550 slides longitudinally along the slot 510 to laterally translate the cam 210 on which the Picatinny rail 110 attaches.

Various exemplary embodiments enable a rail-mounted hardware item (e.g., laser illuminator) to be bore-sighted to other line-of sight hardware (e.g., an optical reticule) without the need of adjusting the hardware itself. The bore-sight assembly allows two screws to be adjusted, one for azimuth and one for elevation, to modify the direction that the system is pointed. This system has been successfully implemented for lights, lasers and optics that need to be bore sighted to a weapon or other directional system.

The bore-sight assembly enables an operator to move the Picatinny rail 110 by turning the elevation and azimuth screws 235, 245 at the aft end of the assembly. By physically moving the rail 110, a component attached thereto translates vertically or laterally and therefore modifies its line-of-sight, which can conform to the rifle bore conformed to the rifle bore or other directional device.

For elevation movement, the operator turns the elevation lead screw 235, causing the elevation lead cam 230 to move fore and aft (depending on the turn direction) in the slot 540 cut in the elevation block 140. This action causes the entire elevation block 140 to rotate relative to the housing 120 about the axis of the pivot pin 225. The rail 110 attaches to the elevation block 140 via the pivot shaft 215, and thus translates vertically in response to turning of the elevation lead screw 235.

For azimuthal movement, the operator turns the azimuth lead screw 245, causing the azimuth lead cam 240 to move fore and aft in the rail cam 210 which is attached to the rail 110, which rotates in response about a vertical axis of the pivot shaft 215. All of the components employed for azimuth adjustment ride on the elevation block 140, thus rendering possible independent and repeatable adjustments for both elevation and azimuth alignment. In this manner, the first and second longitudinal axes 340, 470 of the rail 110 and mounting block 410, respectively, can be aligned to be parallel to each other.

This system allows the user to quickly and precisely adjust the azimuth and elevation directions of a light, laser, optics or any such piece of gear. The bore-sight assembly can be constructed from a wide variety of materials. The assembly should be light-weight and repeatable in operation. Preferably, the rail 110 and the mount block 410 are composed of anodized aluminum and the other components be made of 4000-series steel with nickel plating for corrosion resistance. Also, preferably, the lead screws 235, 245 can be made from high-strength stainless steel.

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments.

What is claimed is:

1. An alignment mount for adjusting elevation and azimuth between first and second axes substantially parallel to an axial direction and substantially perpendicular to lateral and vertical directions with a pitch plane formed by said axial and vertical directions, a yaw plane formed by said axial and lateral directions and a roll plane formed by said lateral and vertical directions, said mount detachably disposable to first and second devices corresponding to said first and second axes, said mount comprising:

a first platform attachable to the first device, said first platform including a first slot that extends substantially in the yaw plane;

a second platform attachable to the second device, said second platform including a first bore and a first channel extending in tandem substantially in the axial direction;

an elevation block insertable into said first channel, said elevation block including a second bore, a second channel and a second slot, said second bore and said second channel extending substantially in the axial direction, said second slot extending substantially in the pitch plane;

an elevation screw rotatable within said first bore in the roll plane;

an elevation cam translatable within said first channel for engaging with said second slot to rotate one end of said elevation block in the pitch plane in response to turning of said elevation screw;

an azimuth screw rotatable within said second bore in the roll plane; and an azimuth cam translatable within said second channel for engaging with said first slot to rotate said first platform in the yaw plane in response to turning of said azimuth screw.

2. The mount according to claim 1, wherein said elevation block and said first platform are pinned together at an opposite end to said first end.

3. The mount according to claim 1, wherein said elevation cam comprises an elevation slider and an elevation pin, with the elevation slider translating within said first channel and impinging said elevation block in the axial direction, and with said elevation pin impinging within said second slot and along said elevation screw.

4. The mount according to claim 1, wherein said azimuth cam includes an azimuth button, with said azimuth cam sliding along said azimuth screw, and with said azimuth button impinging within said first slot and along said azimuth screw.

5. The mount according to claim 1, wherein said first platform includes a Picatinny rail and a plate with said first slot.

6. The mount according to claim 5, wherein said elevation block further includes a knob that restricts relative movement between said Picatinny rail and said plate in the axial direction.

7. The mount according to claim 1, further including a pivot pin insertable in co-linear orifices of said second mount and said elevation block towards said one end, said orifices being substantially parallel to the lateral direction.

* * * * *